US009422725B1

(12) United States Patent
Brookheart

(10) Patent No.: US 9,422,725 B1
(45) Date of Patent: Aug. 23, 2016

(54) VENT ASSISTED SINGLE PLY ROOF SYSTEM

(71) Applicant: Brian E. Brookheart, Olney, IL (US)

(72) Inventor: Brian E. Brookheart, Olney, IL (US)

(73) Assignee: VADA, LLC, Olney, IL (US)

( * ) Notice: Subject to any disclaimer, the term of this patent is extended or adjusted under 35 U.S.C. 154(b) by 0 days.

(21) Appl. No.: 14/847,177

(22) Filed: Sep. 8, 2015

Related U.S. Application Data

(60) Provisional application No. 62/046,266, filed on Sep. 5, 2014.

(51) Int. Cl.

| | |
|---|---|
| ***E04D 5/14*** | (2006.01) |
| ***E04D 11/00*** | (2006.01) |
| ***E04D 13/17*** | (2006.01) |
| ***E04D 11/02*** | (2006.01) |
| ***E04D 5/10*** | (2006.01) |

(52) U.S. Cl.
CPC ..... *E04D 13/172* (2013.01); *E04D 5/10* (2013.01); *E04D 11/02* (2013.01)

(58) Field of Classification Search
CPC ..... E04D 3/17; E04D 3/172; E04D 11/02; E04D 3/38; E04D 5/141; E04D 5/142; E04D 5/143; E04D 5/144; E04D 5/148; E04D 11/00; E04D 11/002; E04D 5/12; E04D 13/172
USPC ..... 52/410, 199, 746.11, 94–95, 411
See application file for complete search history.

(56) References Cited

U.S. PATENT DOCUMENTS 3,680,269 A * 8/1972 Fischer, Jr. ..... E04D 13/155 52/60
3,862,527 A * 1/1975 Peterson ..... E04D 3/26 52/262
4,161,854 A * 7/1979 Stelzer ..... E04D 3/3603 248/205.3
4,192,116 A 3/1980 Kelly
4,223,486 A * 9/1980 Kelly ..... E04D 13/17 52/1
4,441,295 A * 4/1984 Kelly ..... E04D 3/3603 52/309.8
4,506,483 A * 3/1985 Phalen, Jr. ..... E04D 11/02 52/302.4
4,557,081 A * 12/1985 Kelly ..... E04D 5/14 52/199
4,574,544 A * 3/1986 Harris, Sr. ..... E04D 13/17 52/199
4,588,458 A * 5/1986 Previsani ..... E04D 5/12 156/252
4,608,792 A * 9/1986 Gerber ..... E04D 13/17 454/240
4,619,100 A * 10/1986 Emblin ..... E04D 13/1606 52/309.4
4,649,686 A * 3/1987 Backenstow ..... E04D 5/143 52/410

(Continued)

*Primary Examiner* — Elizabeth A Quast
(74) *Attorney, Agent, or Firm* — Grace J. Fishel

(57) ABSTRACT

A vent assisted single-ply roof system including an augmented design that incorporates mechanical fasteners, insulation bonding adhesives and membrane bonding adhesives in the turbulent wind vortex areas along the perimeter of the deck as determined by ASCE 7 calculations. Coupled with roof vents for equalizing the pressure under a loose laid membrane in the field-of-roof area outside the turbulent wind vortex areas to reduce membrane stress and resist wind uplift pressures during high wind events.

11 Claims, 3 Drawing Sheets

(56) References Cited

U.S. PATENT DOCUMENTS 4,688,361 A * 8/1987 Kelly ..... E04D 5/143 52/173.1
4,736,562 A * 4/1988 Kelly ..... E04D 5/143 52/173.1
4,741,132 A * 5/1988 Emblin ..... E04D 13/1606 52/404.3
RE32,710 E * 7/1988 Seaman ..... E04D 5/14 52/518
4,860,514 A * 8/1989 Kelly ..... E04D 5/143 52/410
4,864,781 A * 9/1989 Emblin ..... E04D 13/1606 52/404.3
4,888,930 A * 12/1989 Kelly ..... E04D 3/3601 52/309.8
4,965,977 A * 10/1990 White ..... E04D 11/02 52/410
5,213,542 A 5/1993 Kelly
5,251,416 A * 10/1993 White ..... E04D 3/351 52/410
5,740,647 A * 4/1998 Kelly ..... E04D 11/02 52/199
5,800,891 A * 9/1998 Wasitis ..... B32B 3/08 428/194
6,092,344 A 7/2000 Kelly
6,108,993 A * 8/2000 Hageman ..... E04D 11/02 52/309.8
7,001,266 B2 2/2006 Jones et al.
2004/0003563 A1* 1/2004 Burdic ..... E04D 13/16 52/408
2007/0281119 A1* 12/2007 Di Stefano ..... E04D 12/002 428/40.1
2009/0229204 A1* 9/2009 Kassem ..... E04D 13/17 52/302.1
2009/0255201 A1* 10/2009 Kraus, Jr. ..... B29C 39/18 52/309.5
2010/0088974 A1* 4/2010 Scott, IV ..... E04H 9/10 52/79.5
2014/0075980 A1* 3/2014 Villar ..... F24F 13/32 62/297
2014/0260036 A1* 9/2014 Freeman ..... E04D 5/145 52/412
2016/0024795 A1* 1/2016 Freeman ..... E04D 11/02 52/302.1

* cited by examiner

VENT ASSISTED SINGLE PLY ROOF SYSTEM

BACKGROUND OF THE INVENTION

1. Field of the Invention

The present invention relates to a vent assisted design assembly for increased wind resistance of membrane roofs using active roof vents and augmented perimeter attachment.

2. Brief Description of the Prior Art

Single-ply roofing systems using EPDM (ethylene propylene diene) rubber, chorosulphanated polyethylene, TPO (thermoplastic polyolefin), PVC (polyvinylchloride), and other synthetic single layer sheets as the top layer of water impervious material are especially advantageous for flat or low pitch roofs, such as found on large commercial buildings. When wind rolls over the edges of a roof, a vortex is created which is most intense along perimeter edges and particularly at corners. This vortex creates an uplift pressure which can cause a single-ply membrane to peel starting in the turbulent wind vortex areas of the perimeter edges. In the field-of-roof area inside the corners and perimeter, wind uplift is diminished.

All single-ply roofing systems have two main challenges: Making seams via heat welding, adhesives, caulks and tapes; and, Designing a system that keeps the membrane on the roof in high wind. Everything done on a roof project is related to those two tasks, with most of the engineering and design being spent on the latter.

There are a number of techniques used to keep membranes on top of the roof. These include: (1) Stone Ballast—inexpensive but the weight added to the building is a concern; (2) Fully Adhered, i.e. gluing the membrane to the substrate using adhesives—expensive and there is growing concern over volatile organic compounds (VOCs) contained in the glue being released into the environment; (3) Mechanically Fastened—inexpensive, lightweight, lower VOC's but trapping moisture under the membrane and flutter fatigues are concerns and (4) Vented devices to equalize wind uplift pressure.

The Thomas L. Kelly, Roof Equalizer patent (U.S. Pat. No. 4,223,486) laid the foundation for using roof vents to equalize wind uplift. The patented vent was commercialized by the 2001 Company but the balance of the Kelly roof system was flawed. In the 2001 Company systems the membranes are mechanically fastened at the roof edge and glued for 24 or 30 inches at the corners and along the perimeter edges. Although the patented roof reduces wind uplift pressure, the corners and perimeter of the membrane tend to begin to flutter as a first stage of peeling as membranes shift and adhesives dry out which can result in catastrophic roof failure. Most of the engineering and design effort in the single-ply roof industry after Thomas L. Kelly's passive vent has been focused on differing vent designs such as turbine vent systems like those made by Burke Industries or Venturi vents licensed by Virginia Tech Intellectual Properties, Inc. Neither of which have addressed the need for increased perimeter attachment or for identifying the most effective location for the vent.

BRIEF SUMMARY OF THE INVENTION

In view of the above, it is an object of the present invention to provide a vent assisted single-ply roof system with increased wind resistance. Other objects and features of the invention will be in part apparent and in part pointed out hereinafter.

The present invention relates generally to a vent assisted design that uses augmented perimeters in conjunction with turbine roof vents to provide resistance to wind uplift pressures during high wind events. The design incorporates ASCE 7 identified turbulent wind vortex areas with a vent assisted field-of-roof area for maximum wind uplift resistance over the life of the roofing system.

In an aspect of the invention, a perimeter augmented design incorporates mechanical fasteners, low-rise foam adhesives and membrane bonding adhesives in combinations that surpass wind uplift requirements of a given building perimeter ensuring that the roof performs in high wind uplift conditions. The combination of mechanical fasteners, low-rise foam adhesives and membrane bonding adhesives reduces damage in the turbulent wind vortex areas of the deck.

With the perimeter adequately protected against wind uplift in the turbulent wind vortex areas, the balance of the roof is protected against wind uplift using turbine roof vents. In an embodiment, the turbine roof ventilators are distributed in the interior of the field-of-roof area at a rate of one per 6,000 square feet, minimum. In some embodiments, a vacuum distribution membrane comprising a porous plastic mesh is installed between the ventilators. Wind blowing over the roof surfaces causes the turbine to spin, creating a vacuum, holing the roof membrane in place.

The invention summarized above comprises the methods and constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
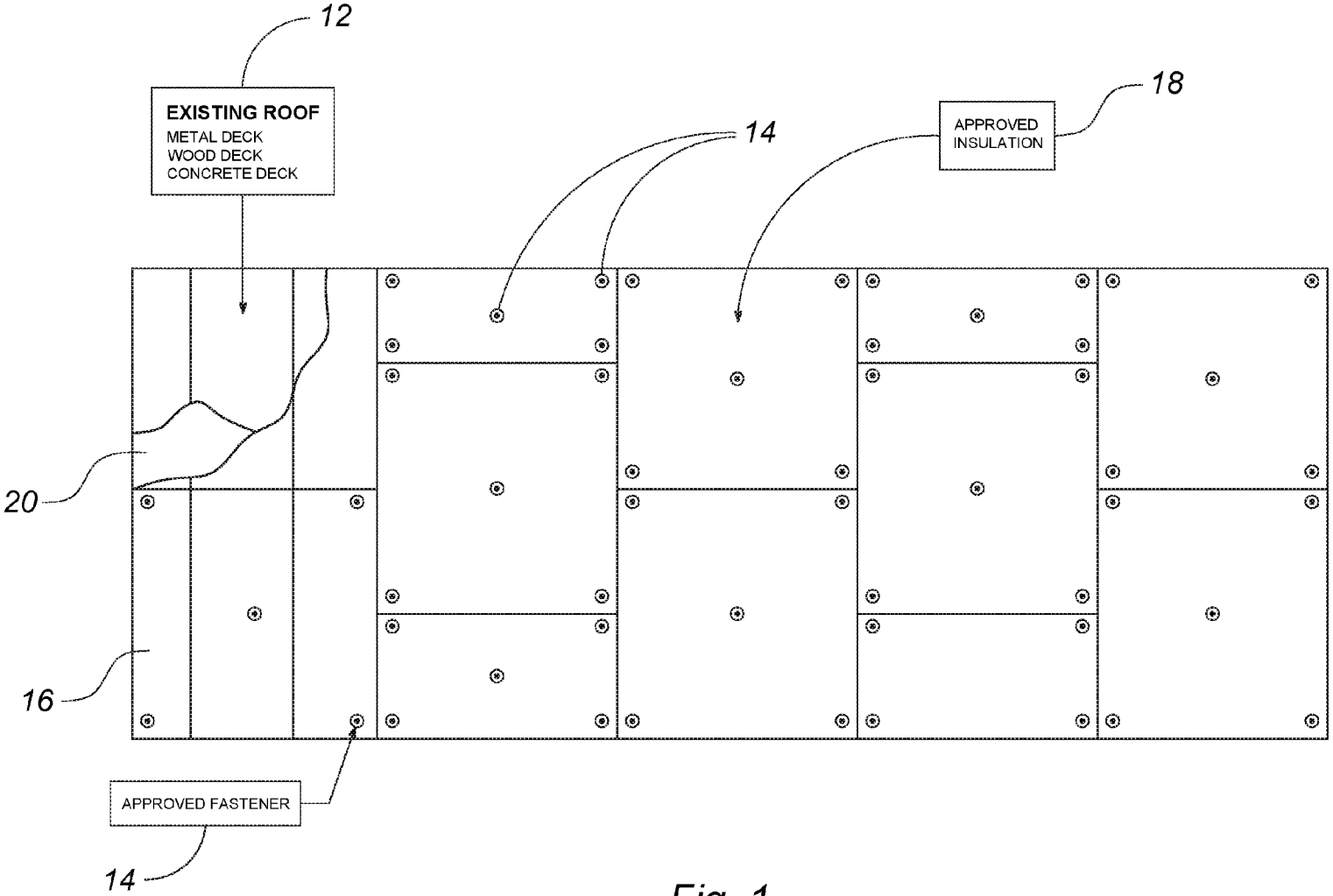
FIG. 1 is a diagram illustrating a roof deck to which insulation is adhesively secured in the turbulent wind vortex areas shown in FIG. 3 and then mechanically fastened.
Figure 2:
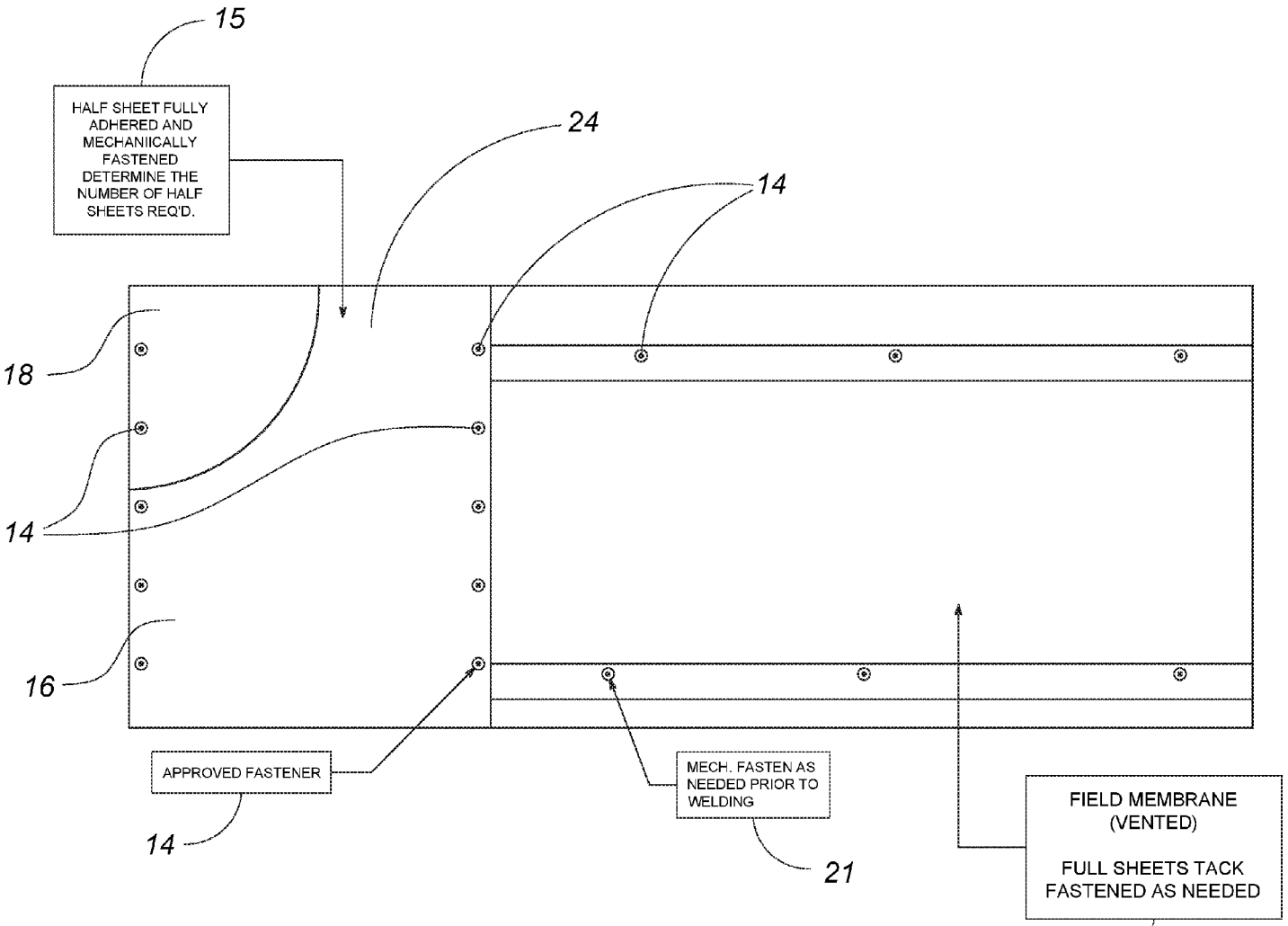
FIG. 2 is a diagram showing half sheets of membrane adhesively secured and mechanically fastened in the turbulent wind vortex areas and membrane loose laid and tacked where necessary in the field-of-roof area inside the turbulent wind vortex areas shown in FIG. 3; and, FIG. 3 is a diagram showing a roof perimeter which has been identified as the turbulent wind vortex areas and a field-of-roof area inside the turbulent wind vortex in which vents are installed for equalizing the pressure under the loose laid membrane.
Figure 3:
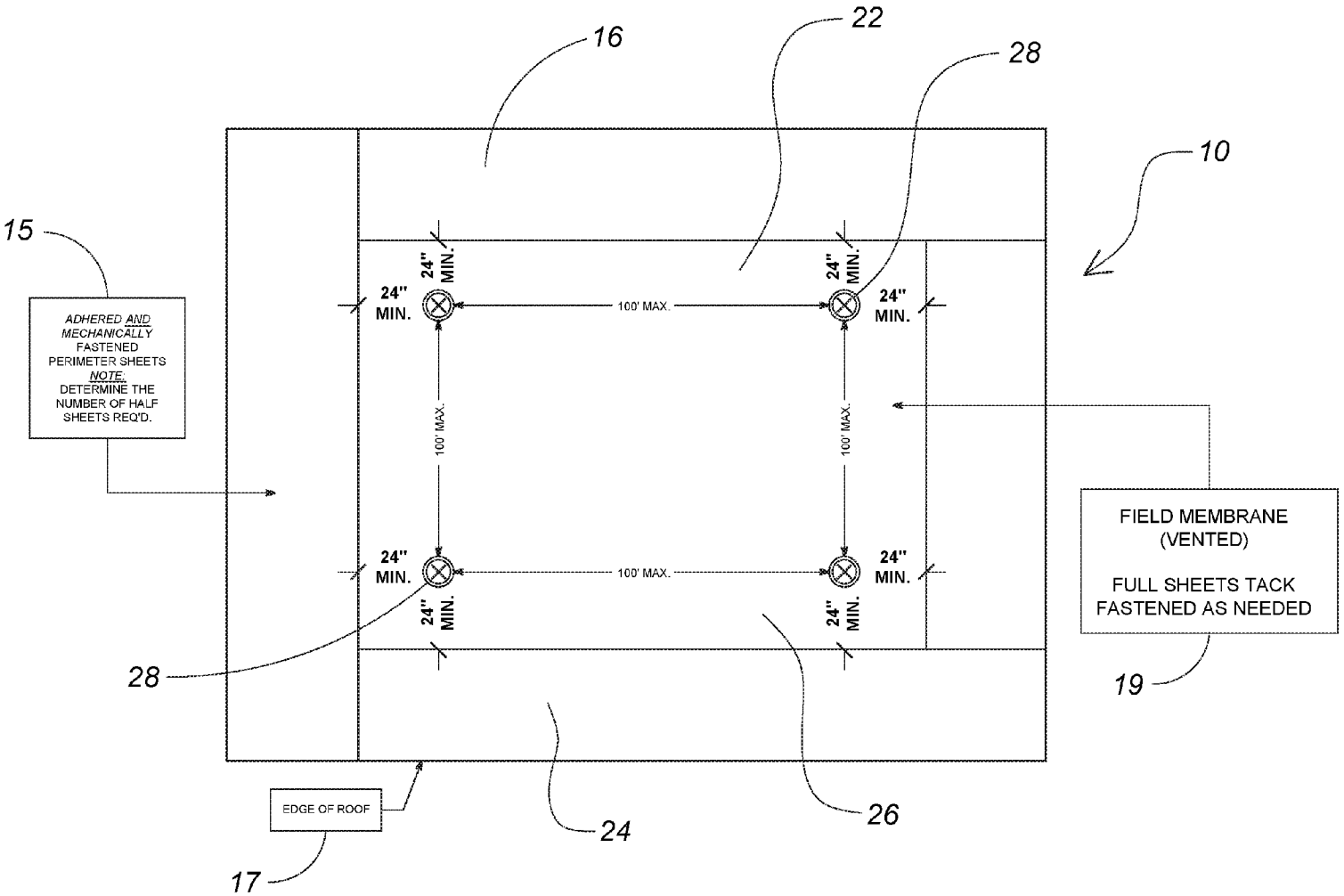

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific methods and constuctions illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the drawings more particularly by reference character, a roof structure 10 in accordance with the present invention is constructed with a single-ply membrane over a layer of insulation. Suitable membranes include EPDM, chlorosulphanated polyethylene, TPO, PVC and other synthetic single layer sheets used for low-slope buildings. The building system described below changes little with different membranes and the following discussion does not attempt to describe the differences in various membrane sheets. For example, in the following disclosure it will be apparent that seams are required in applying a membrane to a flat or low slope deck 12. It is assumed that a person skilled in the art knows that PVC and TPO sheets are welded and that EPDM sheets are taped and therefore it not necessary to disclose how to make those seams and welds. Nor is the following disclosure intended to be complete instructions for installing a single-ply roof, per se. It is assumed that the roofing professional already has a base of knowledge upon which the disclose will be understood.

Before beginning constructing a single-ply roof in accordance with the present method, deck 12 should be inspected to determine that it is structurally sound and capable of holding the mechanical fasteners or adhesives that are applied. Deck 12 should be dry (free from moisture). Infrared scans or equivalent means may be used to detect moisture and no moisture should be left in contact with the roof deck. Decks 12 that are not structurally sound should be repaired or replaced prior to installation of roof structure 10. The present system may be advantageous used on gypsum, tectum, poured concrete, single Ts, double Ts, pre-stressed concrete, and other "non-nailable" decks, which is a distinct advantage over systems that require pre-drilling a host of mechanical fasteners as mechanical fasteners 14 in roof system 10 are only required in a turbulent wind vortex area 16 as described below.

As a first step, the turbulent wind vortex area 16 of deck 12 is determined by using ASCE 7 wind uplift calculations based data gathered about the building and the surrounding geography such as the building's overall height, the terrain surrounding the structure, whether or not the building has parapet walls, and it does, their height, etc. The roof perimeter and corners are exposed to higher uplift forces than the field-of-roof. The maximum uplift forces occurs at the corners when the wind blows at an angle of about 45 degrees to the roof (i.e., roughly along the diagonal). The maximum uplift force along the windward roof perimeter occurs when the wind blows at 90 degrees to the perimeter. As mentioned above, actual pressure coefficients at the corners and perimeter vary depending on the deck height, parapet height, roof slope, etc.

An earlier version of ASCE 7 (ASCE 7-05) used a single basic wind speed map. For each building risk category, an importance factor and a wind-load factor determine ultimate wind loads. The newer version of ASCE 7 (ASCE 7-10) uses building occupancies. Based on ASCE 7 calculations, a rule-of-thumb has been developed to determine the width of the turbulent wind vortex area 16 generally designated the perimeter of the deck 12. Using that rule-of-thumb method, the with of the perimeter 16 (i.e., turbulent wind vortex area) may be determined by using ten percent of a shortest side of the deck 12 or 40 percent of the height of the deck 12 but using never less than 5 feet as the width of the perimeter.

Next, an approved layer of insulation 18 is set in a solid layer of adhesive 20 such as a low-foam urethane. The layer of insulation 20 is then mechanically fastened 14 in place. For this purpose, a minimum of 6 fasteners per 4'×8' sheet and 5 fasteners per 4'×4' sheet are recommended. For use in the perimeter 16 (i.e., the turbulent wind vortex area), EPS insulation should not be used. EPS insulation is acceptable in the field-of-roof area 22 inside the perimeter 16. The fasteners used depend upon the composition of the deck 12. For example, if the deck is gypsum deck, a fastener with the highest pull out resistance in gypsum may be selected. Carbon steel washers with the mechanical fasteners 14 are preferred in the corner areas which experience the highest uplift pressures. Outside the perimeter 16, a layer of insulation 18 in the field-of-roof area 22 may be attached in an approved manner, for example with mechanical fasteners or strips of adhesive.

Single-ply membrane 24 is then glued to the under layer of insulation 18 in the turbulent wind vortex area 16 and overlapping strips are welded or taped depending on the membrane used 15. When the membrane is provided in 10 foot wide rolls, the roll may be advantageously cut in half. While 5 foot strips are used commercially, it will be understood that membrane comes in broad variety of widths, ranging from 7.5 feet to 50 feet. However, 5 foot wide strips have been found advantageous in the turbulent wind vortex area 16. Mechanical fasteners 14 are then used to fasten each side of each strip with the first strip fastened along the edge of the roof 17 and the fasteners spaced 12 inches on center. Additional five-foot wide strips were overlapped to cover the fasteners in the previous row and then welded to create a watertight seal 21. The strip was then adhesively adhered to the insulation and then mechanically fastened with a maximum spacing of the fasteners 12 inches on center. Increased fastening density for the single-ply membrane in the turbulent wind vortex area 16 is obtained by using narrower sheets and rows of fasteners on both sides. The balance of the roof is finished 19 with a membrane loose laid 26 over the under layer of insulation in the field-of-roof area 22. A row of fasteners are provided at the transition between the perimeter 16 to the field-of-roof area 22 to prevent any flutter coming into the perimeter sheets originating in the field-of-roof area 22.

One or more roof vents 28 are installed in the field-of-roof area 22. A roof vent does not create enough vacuum to overcome the turbulent uplift vortex in a roof's perimeter but wind uplift is diminished as one moves farther from the roof's edge. In the field-of-roof area 22 out of the turbulent wind vortex areas 16, vacuum-producing roof vents are effective at counteracting wind uplift on the membrane. Updated versions of "whirlybird" turbine vents are preferred as described below over the equalizer vents sold by the 2001 Company or those sold under the trademark V2T.

Placement of the vents 28 (whether whirlybird style or otherwise) may be empirically determined where the wind flow is highest inside the field-of-roof area by observations made on the roof. But as a rule-of-thumb, vents 28 may be effectively placed 24 inches from the turbulent wind vortex area 16, i.e., 24 inches from the perimeter along the edge of the deck and 24 by 24 inches from the corners. Vents 28 may be spaced farther from the turbulent wind vortex area 16 but preferably not much closer.

As mentioned above, a comparison was made between a "whirlybird" roof vent like that described in U.S. Pat. No. 4,608,792 and second and third vents as described below. The "whirlybird" turbine derives power from wind blowing in any direction. The turbine spins a series of fans in the duct beneath the turbine, which actively pull air from beneath the membrane. By creating a negative differential pressure underneath the membrane, compared with atmospheric pressure above it, the vent ensures that the membrane stays attached to the surface. The second vent was shaped somewhat like a mushroom, bringing air in and out underneath the "cap." The third vent consisted of two domes facing each other, in order to compress the wind between them and increase the speed. The second and third vents unlike the "whirlybird" turbine rely on the Venturi effect to create negative pressure, rather than moving parts.

In all three vent systems, the primary function is to equalize pressure beneath the membrane and provides some small measure of securement for the membrane. The effectiveness of the three vents at equalizing pressure under a membrane was compared, it being proposed that the vent that more rapidly removes over-pressured air from the volume beneath the membrane should be superior in a high-wind situation.

For calculating the limiting flow rates, the minimum cross sectional areas were determined for each vent. The "whirlybird" vent has a single 6" diameter throat, giving a cross section of 28.27 in2. The second vent ("mushroom") had a similar 6" throat, giving the same 28.27 in2 area. The third vent ("domes") had a much different shape, and its minimum cross section is located where it moves air through three tubes, each with a measured inner diameter of 0.615". This results in a much smaller cross section of 0.891 in2.

The Bernoulli principle, shown in equation (1), allows one to calculate equivalent energies for fluid flow at different points in a system. For our calculation, we will use the form $$12povo2+pgzo+Po=12pfvf2+pgzf+Pf \quad (1)$$

where $\rho_o$=initial fluid (air) density $\rho_f$=final fluid (air) density $v_o$=initial fluid velocity (the air is initially at rest)

$v_f$=final fluid velocity $z_o$=initial fluid height, $z_f$ (very small change, neglect for gas)

$P_o$=initial pressure (atmospheric)

$P_f$=final pressure (inside the vent)

g=acceleration due to gravity

Solving equation 1 for $v_f$ yields the equation:

$$vf=2pf(Po-Pf) \quad (2)$$

where $(P_o-P_f)$ is equivalent to the differential pressure. Using the pressure values from section 2.2, we use equation 2 to calculate the following:

| | Differential pressure inside vent (psf) | Minimum cross section ($in^2$) | Air velocity (in/s) | Volumetric flow ($in^3/s$) [cfm] | Flow ratio, compared to VADA |
|---|---|---|---|---|---|
| VADA Vent | 13.5 | 28.27 | 1,285 | 36,320 [1,261] | 100% |
| "Mushroom" vent | 3.1 | 28.27 | 643 | 18,180 [631] | 50% |

-continued

| | Differential pressure inside vent (psf) | Minimum cross section ($in^2$) | Air velocity (in/s) | Volumetric flow ($in^3/s$) [cfm] | Flow ratio, compared to VADA |
|---|---|---|---|---|---|
| "Domes" vent | 26 | 0.891 | 1,788 | 1,590 [55] | 4% |

While the "mushroom" vent had the same cross sectional area as the "whirlybird" vent, it generated less than one quarter of the pressure. As a result, the "whirlybird" vent will evacuate air twice as fast as the "mushroom" vent.

Although the "domes" vent created a larger pressure differential, the tiny cross sectional area of the three tubes did not match the large throat of the "whirlybird" vent as to volumetric flow. Hence for any given roof membrane, the "whirlybird" vent will evacuate over-pressured air approximately 23 times faster than the "domes" vent.

The calculated values are the initial rates at the start of a gust; velocity and flow rates will decline as pressure differential equalizes. This applies to all three vents, however, the volume flow rates of the "domes" and "mushroom" vents will always be significantly less than that of the "whirlybird" vent. Furthermore, Bernoulli's principle shows that fluid velocity is proportional to the square root of pressure. Since the "domes" vent starts at a higher pressure differential, during equalization the pressure differential will drop faster than it does with the "whirlybird" vents.

The "whirlybird" vent and the other two vents all work by equalizing the pressures below and above the roof membrane. However, the "whirlybird" turbine removes air at a rate approximately 2 times faster than the "mushroom" and 23 times faster than the "domes" vent. The second and third vents are therefore less useful as pressure equalizers.

The above calculations have been confirmed in the field. A "whirlybird" vent when located in the field-of-roof area as described above creates enough vacuum to keep the membrane in the field-of-roof area 22 flat so that there is no peel, shear or stress transferred to the seams. Seams that are not stressed by movement are much likely to leak.

The following example illustrates a vent assisted single-ply roof system applied to re-roofing a flat deck.

Example

A store in a retail strip center formed of masonry and having a dead flat metal deck with a gravel surfaced built-up roof was re-roofed as follows:

(1) The width of the turbulent wind vortex area 16 was calculated as 40% of the height of the deck.

(2) Tapered isocyanate insulation ⅛" thick was adhered to the deck in the turbulent wind vortex area with low rise urethane adhesive.

(3) The insulation in the turbulent wind vortex area 16 and in the field-of-roof area outside the turbulent wind vortex area was then mechanically fastened in place using metal fasteners.

(4) A five-foot wide sheet of 45 mil TPO was adhesively adhered to the insulation along the deck perimeter in the turbulent wind vortex area. The interior side of the five foot sheet was fastened with mechanical fasteners and then the exterior side was mechanically fastened. Working inwardly in the turbulent wind vortex area 16, additional five-foot wide sheets were welded together with the next strip covering the fasteners in the previous strip to create a watertight seal. The following strip was then adhesively adhered to the insulation and then mechanically fastened.

(5) Sheets of membrane were loose laid and welded together over the field-of-roof area.

(6) Whirlybird turbines were installed in the field-of-roof area outside of the turbulent wind vortex area. Placement of the whirlybird may be determined by placing the vent on the deck outside the turbulent wind vortex area and watching whether it spins. In general, vent placement 24 inches from the turbulent wind vortex area is satisfactory but a few feet in one direction or another will not effect performance of the roof system. Vent bases were used to elevate the turbine above the parapet walls. Competing vent systems emphasize the necessity of placing the vents in the wind vortex of the roof but as a practical matter place them in the same place on each roof even though the wind vortex can change with varying factors of each roof. The present method locates the vents out of the turbulent wind vortex areas but in an area where the wind blows.

(7) The re-roofing project involved other steps not relevant to the present invention as will occur to those skilled in the art.

The attachment along the perimeter is "over designed" but roofs blow off from the perimeter in. Then, in the field-of-roof area vents are installed. The combination of augmented, redundant perimeters paired with superior turbine vents as described above produces a vented roof with increased wind resistance. A side effect of venting air under the roof membrane is a drying action which permits the possibility of re-roofing a completely saturated deck under undesirable conditions.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

What is claimed:

1. A ballast free method for improving single ply roof performance in wind conditions on a roof having a substantially flat deck with turbulent wind vortex areas and a field-of-roof area outside the turbulent wind vortex areas, said turbulent wind vortex areas having a higher wind load than the field-of-roof area, comprising:

determining the turbulent wind vortex areas of the substantially flat deck, gluing and mechanically fastening an under layer of insulation to the substantially flat deck in the turbulent wind vortex areas and field-of-roof area, gluing and mechanically fastening a single ply roofing membrane to the under layer of insulation in the turbulent wind vortex areas, said single ply roofing membrane having a row of mechanical fasteners along a first edge at a roof edge and a row of mechanical fasteners along a second edge;

loose laying the single ply roofing membrane over the entirety of the under layer of insulation in the field-of-roof area, said single ply roofing membrane in the turbulent wind vortex areas having a row of mechanical fasteners on a transition between the turbulent wind vortex areas and the field-of-roof area; and, installing at least one vent only in the field-of-roof area outside of the turbulent wind vortex areas.

2. The method of claim 1 wherein the turbulent wind vortex areas are determined in accordance with ASCE 7-05 or ASCE 7-10 standards at the date of filing.

3. The method of claim 1 wherein the under layer of insulation and the single ply roofing membrane in the turbulent wind vortex areas are fully adhered.

4. The method of claim 1 wherein a width of the turbulent wind vortex areas is determined by calculating 40 percent of a deck height or 10 percent of a shortest side but never using less than 5 feet as the width of the turbulent wind vortex areas.

5. The method of claim 4 wherein the at least one vent is a turbine vent installed no closer than about 24 inches of a transition between the single ply roofing membrane in the turbulent wind vortex areas and the singly ply roofing membrane in the field-of-roof area.

6. The method of claim 1 wherein a plurality of strips of the single ply roofing membrane are assembled in the turbulent wind vortex areas.

7. A ballast free vent assisted single-ply roof system comprising:

an under layer of insulation glued to a deck having turbulent wind vortex areas as determined by ASCE 7 standards on the date of filing and mechanically fastened to the deck;

a single-ply membrane glued to the deck in the turbulent wind vortex areas and mechanically fastened, said single-ply membrane in the turbulent wind vortex areas having a row of mechanical fasteners along a first edge at a roof edge and a row of mechanical fasteners along a second edge;

the single-ply membrane is loose laid over the entirety of the deck in a field-of-roof area outside the turbulent vortex areas, said turbulent wind vortex areas having a higher wind load than the filed-of-roof area, said single-ply roofing membrane in the turbulent wind vortex areas having a row of mechanical fasteners on a transition between the turbulent wind vortex areas and the field-of-roof area; and, at least one roof vent installed in the field-of roof area only, said at least one roof vent capable of equalizing pressure beneath the single-ply membrane.

8. The system of claim 7 wherein the at least one roof vent is a turbine vent.

9. The system of claim 7 wherein the turbulent wind vortex areas have a width equal to 40 percent of a height of the deck or 10 percent of a shortest side of the deck but is not less than 5 feet wide.

10. The system of claim 7 wherein the at least one roof vent is positioned no closer than about 24 inches of a transition between the single-ply membrane in the turbulent wind vortex areas and the field-of-roof area.

11. A ballast free vent assisted single-ply roof system comprising:

an under layer of insulation fully adhered to a substantially flat deck having turbulent wind vortex areas as determined by ASCE 7 standards on the date of filing and mechanically fastened to the substantially flat deck;

a single-ply membrane fully adhered to the under layer of insulation in the turbulent wind vortex areas and a field-of-roof area outside the turbulent wind vortex areas and mechanically fastened, said turbulent wind vortex areas having a higher wind load than the field-of-roof area;

a single-ply membrane loose laid over the entirety of the under layer of insulation in the field-of-roof area outside the turbulent vortex areas, said single-ply membrane in the turbulent wind vortex areas having a row of mechanical fasteners on a transition between the turbulent wind vortex areas and the field-of-roof area; and, at least one turbine roof vent installed in the field-of roof area only, said turbine roof vent capable of equalizing pressure beneath the single-ply membrane.

* * * * *